US007448309B2

(12) United States Patent
Bitter

(10) Patent No.: US 7,448,309 B2
(45) Date of Patent: Nov. 11, 2008

(54) HYDRAULIC ARRANGEMENT

(75) Inventor: Marcus Bitter, Contwig (DE)

(73) Assignee: Deere & Company, Moline, IL (US)

( * ) Notice: Subject to any disclaimer, the term of this patent is extended or adjusted under 35 U.S.C. 154(b) by 687 days.

(21) Appl. No.: 11/077,596

(22) Filed: Mar. 11, 2005

(65) Prior Publication Data

US 2005/0199120 A1 Sep. 15, 2005

(30) Foreign Application Priority Data

Mar. 13, 2004 (DE) ..... 10 2004 012 382

(51) Int. Cl.
*F15B 11/024* (2006.01)
*B66F 9/065* (2006.01)
*E02F 9/22* (2006.01)

(52) U.S. Cl. ..... 91/418; 91/436

(58) Field of Classification Search ..... 91/418, 91/436, 437, 438, 439, 440
See application file for complete search history.

(56) References Cited

U.S. PATENT DOCUMENTS 5,622,226 A * 4/1997 Hausman et al. ..... 701/50
6,068,064 A * 5/2000 Bettin et al. ..... 91/452
6,460,623 B1 * 10/2002 Knussman et al. ..... 172/315

FOREIGN PATENT DOCUMENTS

| | | |
|---|---|---|
| DE | 195 48 943 | 12/1995 |
| DE | 196 08 758 | 3/1996 |
| DE | 199 31 142 | 7/1999 |
| DE | 100 06 908 | 2/2000 |
| DE | 102 27 966 | 6/2002 |
| DE | 103 07 346 | 2/2003 |

OTHER PUBLICATIONS

DIN ISO 1219-1, Mar. 1996, 4 Pages.

* cited by examiner

*Primary Examiner*—Thomas E Lazo

(57) ABSTRACT

A hydraulic arrangement for implementing a float position is provided. The arrangement includes: a hydraulic cylinder having a first chamber and a second chamber, a first supply pipe connected to the first chamber and a second supply pipe connected to the second chamber; a volumetric control valve assembly located within a hydraulic pipe and arranged between the first and second chamber; a hydraulic fluid feeder in fluid communication with a hydraulic reservoir; and a controller having a raise position, a lower position, a neutral position, and a float position to control the hydraulic cylinder. The second supply pipe is fluidly connected to the hydraulic reservoir and the first and second supply pipes are substantially prevented from being fluidly connected to the hydraulic fluid feeder when the controller is in the float position.

12 Claims, 2 Drawing Sheets

HYDRAULIC ARRANGEMENT

BACKGROUND OF THE INVENTION

Hydraulic arrangements with implemented float positions enabling free movement of a hydraulic cylinder are known in current technology. Both connection sides of the hydraulic cylinder are connected not only to each other but also at low or zero pressure to a reservoir or hydraulic container. Such types of hydraulic arrangement are utilized in construction and/or loading vehicles, such as telescopic loading or front loading vehicles, on which a boom or lever can be raised or lowered by means of a lifting cylinder. The function of the float position is utilized for example to enable a tool mounted on the vehicle boom or lever to follow the ground contours with precision independently from vehicle position and location. The tool is thus pressed on the ground by the force of gravity alone.

Designing hydraulic arrangements with float positions incurs high cost particularly if a load holding valve is provided for safety purposes to prevent or significantly decelerate any unforeseen lowering of the boom or lever caused by the occurrence of a leak in the connection between cylinder and controller. Opening or circumventing the load holding valve generally requires a control pressure to open the valve. In the float position the hydraulic cylinder is at zero pressure and no control pressure is available without some additional device. In order to exert this control pressure such types of hydraulic arrangements have to be fitted with additional on/off valves and/or hydraulic pipes. These additional fittings serve as needed to make or break the connection between the rod side of the hydraulic cylinder and the hydraulic reservoir.

DE 10006908A1 describes a hydraulic piston cylinder assembly for agricultural machinery with a load holding valve enabling a working position to be attained in which a constant pressure can be set at the piston base side of the cylinder chamber. Thereby a boom or a tool mounted on it can rest on the ground with a pre-selected contact pressure. To attain this working position the pressure chambers of the piston cylinder assembly are connected to each other and the pressure between the two pressure chambers is equilibrated by means of a pressure regulator. If the pressure falls below a pre-selected level, the regulator closes. A float position here possible only if the pre-selected level is set to zero so that no pressure regulation occurs. This has the disadvantageous effect that when switched off under load the boom or tool descends uncontrollably.

German patent application DE 10307346 describes a valve arrangement which includes a load holding valve and enables a float position for a hydraulic cylinder. To permit lowering the hydraulic cylinder under load, a special on/off valve is provided in an additional hydraulic pipe connected to a hydraulic reservoir. Not until this on/off valve is closed can the necessary control pressure be generated to open the load holding valve. Moreover, in such a type of hydraulic arrangement, undesirable switch settings or incorrect switch activation may conceivably arise to increase the complexity of valve relationships or to lead to operator error.

SUMMARY OF THE INVENTION

The task of the present invention is to improve a hydraulic arrangement of the type described at the outset so as to enable a reduction in the cost of implementing a "lower function" under load while also enabling a fully functional float position. In particular, the complexity of valve relationships as well as the risk of operator error and undesirable switch settings should be reduced.

A hydraulic arrangement for implementing a float position is provided, including a hydraulic cylinder having first and second chambers, a hydraulic reservoir, a hydraulic fluid feeder, a hydraulic pipe arranged between the first and the second chamber, an on/off valve arranged in the hydraulic pipe, a volumetric control valve assembly arranged in the hydraulic pipe, a first supply pipe for the first chamber, a second supply pipe for the second chamber, an automatic shut-off valve arranged in the first supply pipe, and a controller. The controller includes a raise position, a lower position, a neutral position, and a float position for controlling the hydraulic cylinder.

According to the invention, a hydraulic arrangement of the type described above is designed in such a way that the controller contains the switch position representing a float position so that by means of the controller at least the second supply pipe can be connected to the reservoir while at the same time connections between both supply pipes and the feeder are interrupted. Having a controller with such a fourth switch position eliminates the necessity for a second on/off valve to connect the second chamber of the hydraulic cylinder to a reservoir, as was provided in previous solutions. This significantly reduces the technical cost particularly because no additional hydraulic arrangement is now required to implement the "lower function" under load. Hence, preferably only one on/off valve is utilized which alone suffices to connect the first chamber to the second chamber.

A fourth switch position according to the invention offers the advantage that alongside the raise position and lower position an additional neutral position can be provided for the hydraulic cylinder in which both supply pipes are closed. In the neutral position the connection between the lower side of the hydraulic cylinder and the hydraulic reservoir should preferably be closed since there are applications with wheel loaders, telescopic loaders and also front loaders where a particular contact pressure should be exerted on a boom-mounted tool which would be impossible in the case of a continuous connection to the reservoir and hence would be disadvantageous in comparison with competing products. It is therefore advantageous to add a fourth switch setting according to the invention and thus to enable both raise and lower, as well as neutral positions.

The controller can be designed in such a way that when the controller is in the fourth switch position the first supply pipe is switched together with the second supply pipe and both supply pipes are connected to the hydraulic reservoir while the second inlet to the controller is closed so that no supply occurs on the feeder side. Such a fourth switch position representing a float position is not strictly necessary. It suffices if the fourth switch position simply connects the second supply pipe of the hydraulic cylinder to the hydraulic reservoir.

In the float position the controller connects the second supply pipe or the first and second supply pipes respectively directly to the hydraulic reservoir and therefore there is no need for any additional valve or other device (apart from a pipe connecting the controller to the reservoir). The controller can be designed for manual or electrical operation, while of course other methods are also conceivable, for example pneumatic or hydraulic methods, which however will not be described in greater detail.

The on/off valve preferably includes a closed position and an open position and preferably closes in both directions of flow in the closed position and preferably opens in both directions of flow in the open position so that a float position occurs for the hydraulic cylinder. The on/off valve is preferably electrically operated. It is, of course, also conceivable that other methods of operating the on/off valve can be used, for example manual, pneumatic or hydraulic operation.

If the float position is to be activated, the on/off valve is switched to its open position and the controller to its fourth switch position so as to connect the first and the second chambers of the hydraulic cylinder to each other and to the hydraulic reservoir. To render the hydraulic arrangement as easy to operate as possible and to minimize the risk of operator error, the on/off valve is preferably automatically opened, that is brought to the open position, whenever the controller is in its float position. To this end, some device should preferably be provided to determine whether or not the controller is in its float position. For example, this can consist of a switch that is activated at the controller depending on or independently from the float position. For electro-hydraulically operated controllers the switch is generally unnecessary because this task can be managed by the software of an electronic control unit. It is moreover insignificant how and where the switch position of the controller is acquired since it is simply the result itself that is of interest. A switch as described above can be mounted on a joystick, on an activation mechanism including a tension cable, or directly on the controller. It could conceivably be a proportional signal sensor, with appropriate processing electronics, that generates an electrical signal to switch the on/off valve to the open or closed position. The use of a pressure switch or pressure transducer to determine the control pressure to be transmitted from a hydraulic joystick as the switch signal to the controller is also conceivable. Therefore many possible methods exist to determine the controller switch position and consequently to open or close the on/off valve.

If the boom or lever under load or pressure is to be lowered, setting the controller to the lower position and consequently closing the on/off valve automatically closes the connection from the two chambers to each other and to the hydraulic reservoir. Hydraulic fluid flows into the second chamber of the hydraulic cylinder in which sufficient pressure can now be generated to open the load holding valve, which is essential for lowering the boom or lever. In conventional hydraulic arrangements for float positions with a load holding valve or with an automatic shut-off valve, a second on/off valve is required. This establishes connection to the reservoir, as is necessary for a float position, and must be closed in order to ensure generation of the necessary pressure.

If the boom or lever is to be raised, switching the controller from the float position to the raise position and consequently opening the on/off valve automatically closes the connection from the two chambers to each other. At the same time the controller establishes connection between the second chamber and the hydraulic reservoir.

Hydraulic fluid flows into the first chamber of the hydraulic cylinder and raises the piston of the hydraulic cylinder which forces the hydraulic fluid remaining in the second chamber into the hydraulic reservoir.

If the boom or lever is to be held stationary, switching the controller from the float position to the neutral position and consequently closing the on/off valve automatically closes the connection from the two chambers to each other. At the same time both supply pipes from the controller are closed. Under these conditions no hydraulic fluid can escape from the chambers and hence the boom or lever is held stationary.

Switching from the raise, neutral or lower position to the float position automatically opens the on/off valve and establishes connection from the two chambers to each other and to the hydraulic reservoir.

It is also possible to hold the boom or lever under load or with a definite contact pressure. This involves switching from a raise or lower position directly to the neutral position and hence maintaining the contact pressure generated by the raise or lower position. Since the raise, neutral and lower positions always hold the on/off valve automatically closed, pressure cannot be equilibrated between the chambers. The raise and lower functions of the hydraulic cylinder result from a closed on/off valve due to setting the controller to the raise or lower position by known methods.

The controller is designed preferably as a gate valve containing four switch positions each with two inlets and two outlets. In various ways corresponding to the controller switch functions—raise, lower, neutral (hold) and float—the individual positions make or break connections between the supply pipes and the feeder or reservoir.

The automatic shut-off valve preferably comprises a back pressure valve closing in the direction of the controller and a pressure relief valve whereby the pressure relief valve can be regulated by means of the pressures prevailing in the supply pipes. Regulation is achieved through pilot head pipes running from the pressure relief valve to the first and second supply pipes. The back pressure valve is arranged in a bypass pipe circumventing the pressure relief valve whereby the back pressure valve opens in the direction of the first chamber. Other possible designs of automatic shut-off valve are also conceivable. For example pressure switches can be used to activate an on/off valve in the event of a fall in pressure.

In comparison to conventional hydraulic arrangements with float positions and automatic shut-off valves this provides a more cost-effective hydraulic arrangement by eliminating the need for a second on/off valve with associated plumbing on the side of the second chamber of the hydraulic cylinder and substituting in its place a conventional gate valve with float position function. Eliminating a second on/off valve also reduces the number of potential sources of error since one less component is utilized. Moreover this also offers more cost-effective design possibilities since it requires less space.

Conventionally, and particularly for tractors with front loaders, the hydraulic and electrical connections between front loader and tractor are secured through so-called multi-couplers that enable rapid and simple connection and disconnection. The use of a hydraulic arrangement according to the invention enables these multi-couplers to be retained since no additional pipe connecting the lower side of the hydraulic cylinder to the reservoir is required. The internal connection between the controller in its fourth switch position and the reservoir enables the second chamber of the hydraulic cylinder to be supplied through the already available second supply pipe.

A volumetric control valve assembly has the advantage that the flow rate can be regulated independently from the hydraulic pressure in the hydraulic pipe so that for both low as well as high hydraulic load only a limited volume flows through the hydraulic pipe thus providing a safety precaution. If for example while the first chamber of the hydraulic cylinder is pressurized the hydraulic arrangement is brought to the float position by setting the controller to the float position and thus switching the on/off valve to the flow position, the volumetric control valve assembly ensures that independently from the pressure level the flow varies only within certain limits, alternatively does not exceed a defined value. The valve assembly preferably includes a flow port adjustment device, for example a slide valve or closure, exposed on the one hand to pressure from the first chamber and on the other hand to pressure from the reservoir and simultaneously to a spring force. The adjustment device flow port changes or closes depending on pressure differential between the two flow directions which varies in accordance with the prevailing flow rate.

The valve assembly preferably includes a device to narrow and widen the valve assembly bore in response to rising and falling pressure gradients respectively. If the flow rate increases due to rising pressure in the hydraulic pipe, the pressure gradient between the flow inlet and flow outlet sides also rises. At the same time the valve assembly bore is narrowed so that the pressure gradient falls back. As a consequence of the falling pressure gradient the valve assembly bore is again narrowed to create a controlling or regulating condition that holds the flow rate constant as far as possible and/or within certain limits in the presence of a pressure gradient.

The valve assembly can include a flow regulator that changes the flow rate depending on the flow and limits it to a given maximum value. Such types of flow regulator are offered for example by HYDAC International Co. An exact description can be found in DIN ISO 1219. A flow regulator includes a differential pressure regulator that controls or regulates the flow volumetrically by means of a regulating piston, a spring, a regulating aperture and an adjustment screw for adjusting the regulating pressure differential. With rising flow rate or increasing flow, that is, with rising pressure gradient, the regulating aperture bore is narrowed according to the increase in pressure gradient until equilibrium is restored. Continuous regulation by the differential pressure regulator according to the prevailing pressure gradient delivers a constant flow rate in a control direction, preferably that direction in which the hydraulic fluid flows out of the highly pressurized chamber of the hydraulic cylinder, preferably on the raise side of the hydraulic cylinder, towards the reservoir. In the opposite direction flow can pass unregulated through the valve. A valve of this type has the advantage that even under extremely high pressure it always sets a flow rate according to the regulating pressure differential with the regulating pressure differential being adjustable by means of the adjustment screw. Consequently switching from an operating position to a float position under load produces a controlled pressure drop that is to the greatest possible extent independent from the prevailing pressure level and hence provides a safety precaution during switching to the float position.

The valve assembly preferably includes a back pressure valve that is arranged parallel to the flow regulator and opens in the direction of the first chamber. This ensures that the hydraulic fluid flowing in the direction of the reservoir is forced to flow through the flow regulator and correspondingly flows under control from the highly pressurized chamber while an inflow from the opposite direction can pass unhindered.

In another design according to the invention the valve assembly includes a device for reducing or interrupting the flow rate if a given pressure gradient is exceeded. This ensures that on reaching a flow rate producing the given pressure gradient the connection is interrupted so that pressure is maintained in the highly pressurized first chamber or in the first hydraulic pipe respectively. Should the pressure again drop the connection is re-established as soon as the given pressure gradient is attained or as soon as a flow rate is reached that produces a pressure gradient less than or equal to the given pressure gradient.

The valve assembly preferably includes an automatic shut-off valve that closes if a given pressure gradient is attained or exceeded or opens if the pressure gradient falls below the given level. Such types of automatic shut-off valve are offered for example by HYDAC International Co. and are described in detail in the company's catalog "HYDAC International—FLUTEC automatic shut-off valves RBE". "FLUTEC" automatic shut-off valves are volumetrically switching flat-seat valves that prevent impermissible and uncontrolled movement of a consumer under load. An automatic shut-off valve includes a closure, for example a closing piston in the form of a disc valve that remains open during normal operation. The closure is held open preferably by a spring so long as the force of the spring is greater than that exerted on the closure or on the disc component of the disc valve by the resistance of the passing flow. The valve remains open and flow can pass in both directions. Should the prevailing flow rate through the valve in a given direction exceed the maximum permissible level defined by the given pressure gradient, the force of the spring is overcome by the increased resistance of the flow and the closure is immediately pressed against the valve seat so that the flow is interrupted. The valve opens automatically as soon as pressure is equilibrated and the force of the pressure upstream of the valve falls below the force of the spring combined with that of the pressure downstream of the valve.

The valve assembly includes a choke or aperture that is arranged parallel to the automatic shut-off valve and permits a reduced flow rate when the automatic shut-off valve is closed. This ensures that a certain portion of the flow rate is always carried forward so that pressure cannot build upstream of the valve assembly. The choke or aperture can be arranged in a bypass pipe parallel to the automatic shut-off valve or can for example be designed as an opening directly on the automatic shut-off valve, in particular directly on the disc valve. This ensures that closing the automatic shut-off valve at high flow rates captures a major portion of the flow rate and allows only a small portion of the hydraulic fluid through the choke thus in total providing a controlled pressure drop during switching to the float position.

In combination with the first and second hydraulic pipes that in the float position connect the chambers of the hydraulic cylinder to the hydraulic reservoir an especially advantageous method enables switching from operation with an integrated load holding valve arrangement on the one hand to volumetric control in a float position with the safety features described above on the other hand.

The valve arrangements presented in the various arrangements are utilized preferably for a hydraulic cylinder to raise and lower a boom on a loading or construction vehicle in particular a telescopic loading or front loading vehicle. Thus for example a telescopic loader in any operating position even under load with raised boom can be switched to the float position. A float position lacking the volumetric control described above would lead to a situation where with increasing load the boom would be lowered more or less uncontrollably which would present an increased safety risk. At the same time the load position can be used for work at the ground surface. Moreover the possibility exists for using an integrated load holding valve to pressurize the hydraulic cylinder on the lower side with raised boom by appropriate control through the controller so that an accelerated descent of the boom can occur. Thus safe switching to a float position is assured from all operating positions.

A particular advantage of designs according to the invention is that a float position for a telescopic loader is provided while retaining a load holding valve (automatic shut-off valve) for safety purposes. Moreover a float position is made possible while in comparison to previously known hydraulic arrangements the design costs can be reduced.

DESCRIPTION OF THE DRAWINGS

The invention including further advantages and advantageous forms and developments will be described and explained in detail with the aid of the drawings that show two examples of designs according to the invention.

DESCRIPTION OF THE EMBODIMENTS

Figure 1:
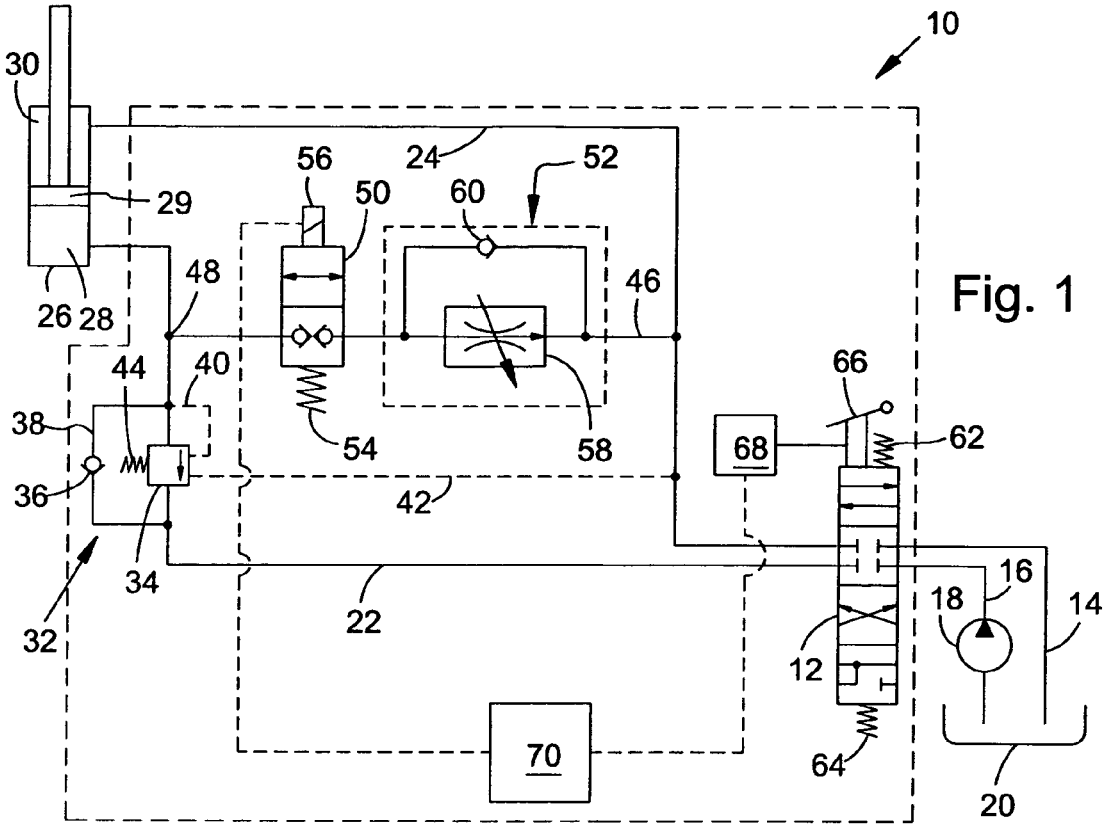
FIG. 1 is a schematic for a first hydraulic arrangement according to the invention with a volumetric regulator as volumetric control valve assembly.

The schematic presented in FIG. 1 shows an example of a design for a hydraulic arrangement 10 for achieving a float position. The hydraulic arrangement 10 contains a switchable controller 12, for example a gate valve, which is connected through hydraulic pipes 14, 16 to a pump 18 and a hydraulic reservoir 20 whereby the controller 12 can be switched to three operating positions: raise, neutral and lower. Switching the controller 12 is preferably performed by manual operation but can also be performed by electrical, hydraulic or pneumatic operation.

The controller 12 is connected through a first and a second supply pipe 22, 24 to a hydraulic cylinder 26 with the first supply pipe 22 leading to a first chamber 28 in the hydraulic cylinder 26 and the second supply pipe 24 leading to a second chamber 30 in the hydraulic cylinder 26. A piston 29 separates the two chambers 28, 30 from each other. The first chamber 28 of the hydraulic cylinder 26 represents the piston base side or raise side chamber, while the second chamber 30 represents the piston rod side or lower side chamber of the hydraulic cylinder 26.

An automatic shut-off valve 32 is provided in the first supply pipe 22. The automatic shut-off valve 32 includes a pressure relief valve 34 regulated by pressure and spring as well as a back pressure valve 36 opening on the hydraulic cylinder side and arranged in a bypass pipe 38 parallel to the pressure relief valve 34. A pressure connection from the pressure relief valve 34 to the hydraulic cylinder side section of the first supply pipe 22 is established by a first head pipe 40. A further pressure connection from the pressure relief valve 34 to the second supply pipe 24 is established by a second head pipe 42. In addition an adjustable spring 44 holds the pressure relief valve 34 in the closed position.

A hydraulic pipe 46 connects the first chamber 28 or alternatively the first supply pipe 22 to the second chamber 30 or alternatively the second supply pipe 24 with one end 48 of the hydraulic pipe 46 connected to the first supply pipe 22 arranged between the first chamber 28 and the automatic shut-off valve 32.

An on/off valve 50 is arranged in the hydraulic pipe 46 with in addition a volumetric control valve assembly 52 arranged behind the on/off valve 50 in the direction of the second supply pipe 24. The on/off valve 50 presents an electrically operated seat which is held in the closed position by means of an adjustment spring 54 and can be brought to an open flow position by means of a solenoid 56. The on/off valve 50 provides a leak-proof seal in both directions. The valve assembly 52 includes a flow regulator 58 arranged in parallel with a back pressure valve 60 with the back pressure valve 60 opening in the direction of the hydraulic cylinder. The valve assembly 52 can also be arranged in the direction of the second supply pipe 24 upstream of the on/off valve 50.

The individual operating positions can be controlled by means of the controller 12 and the on/off valve 50 as follows. As shown in FIG. 1, the controller 12 is held in the neutral position by means of adjustment springs 62, 64. The on/off valve 50 is in a closed position. In response to a control signal or manual operation the controller 12 is switched from the neutral position to the raise, lower or float position by means of an actuator 66. The actuator 66 can be in the form of a manual, electric, hydraulic or pneumatic actuator.

Switching the controller 12 to the float position causes a switch or sensor 68 connected to the actuator 66 to detect the float position status of the controller 12 and to transmit a signal to a control unit 70. The control unit 70 is connected to the on/off valve 50 and holds the on/off valve 50 in, or switches it to, the closed position if the controller 12 is in the float position.

If the controller 12 is in a position other than the float position, the on/off valve 50 is automatically closed by means of a signal transmitted by the control unit 70. The control logic of the control unit 70 is preferably designed to generate a signal to close the on/off valve 50 whenever the controller 12 is switched to a position other than the float position where the switch or sensor 68 detects or acquires the switch position status of the controller 12 and transmits a corresponding switch position status signal to the control unit 70.

In the raise position (uppermost switch position of the controller 12 in FIG. 1) connection is established between the first supply pipe 22 and the pump 18 and between the second supply pipe 24 and the hydraulic reservoir 20. The on/off valve 50 is in the closed position. The pump 18 connected to the hydraulic reservoir 20 fills the first chamber 28 of the hydraulic cylinder 26 through the first supply pipe 22 and through the back pressure valve 36 of the automatic shut-off valve 32 (the pressure relief valve 34 is in the closed position). Consequently the piston 29 moves in the direction of the second chamber 30 and forces the oil therein out through the second supply pipe 24 to the hydraulic reservoir 20. Switching to the neutral position (the second switch position from the top of the controller 12 in FIG. 1) causes the controller 12 to interrupt the connections to the pump 18 and to the hydraulic reservoir 20 so that the pressure in the two chambers 28, 30 of the hydraulic cylinder 26 is maintained and the movement of the piston 29 is stopped. The on/off valve 50 is closed. The piston 29 stands still.

In the lower position (the third switch position from the top of the controller 12 in FIG. 1) connection is established between the first supply pipe 22 and the hydraulic reservoir 20 and between the second supply pipe 24 and the pump 18. The on/off valve 50 is closed. The pump delivers oil to the second chamber 30 of the hydraulic cylinder 26 whereby the rising pressure in the second supply pipe 24 opens the pressure relief valve 34 through the second head pipe 42 of the automatic shut-off valve 32. At the same time the piston 29 moves in the direction of the first chamber 28 so that the oil flowing out of the first chamber 28 proceeds through the first supply pipe 22 and through the opened pressure relief valve 34 to the hydraulic reservoir 20.

The automatic shut-off valve 32 ensures that in the neutral position the hydraulic cylinder 26 maintains its position, that in the raise no oil can escape from the pressurized first chamber 28, and that in the lower position the oil can flow from the first chamber 28 through the opened pressure relief valve 34. In order to ensure this in practice the automatic shut-off valve 32 should be arranged on the raise side of the hydraulic cylinder 26 with the raise side being that side of the hydraulic cylinder 26 on which pressure to raise a load is generated. In the design examples shown here the raise side is the first chamber 28 of the hydraulic cylinder 26, although by rotating the hydraulic cylinder 26 the second chamber 30 could also serve as the raise side. The first head pipe 40 presents an overload protection such that in the event of excessive operating pressure in the first chamber 28 of the hydraulic cylinder 26 caused for example by excessive load a limiting pressure is attained in the first head pipe 40 that opens the pressure relief valve 34 in order to reduce the pressure.

The controller 12 can be switched from any available switch position or in any available operating position to the float position (the fourth switch position from the top of the controller 12 in FIG. 1). Thereby the switch signal generated by the control unit 70 drives the on/off valve 50 so that the solenoid 56 opposes the force of the spring 54 and shifts the on/off valve 50 from the closed position to the open position. Consequently the first chamber 28 and the second chamber 30 are brought into connection with each other and with the hydraulic reservoir 20, thus enabling an exchange of the hydraulic fluid or oil and enabling the piston 29 to float freely. Switching from an operating position to the float position under load causes oil to flow at higher pressure from the pressurized first chamber 28 leading to an accelerated piston movement. To limit the speed of this piston movement the flow regulator 58 commences limiting the flow rate or regulating or controlling the flow of oil. Should the flow rate exceed a permitted value, the bore of the flow regulator 58 is narrowed so that the flow rate no longer rises. This effectively prevents uncontrolled movement of the piston 29.

In case of opposing pressure in the direction of the first chamber 28 the back pressure valve 60 enables circumvention of the flow regulator 58 and thus an unregulated flow in the direction of the first chamber 28. Switching from the float position to an operating position is possible at any time by switching the controller 12 to the raise, neutral or lower position. The on/off valve 50 is then automatically closed.

Figure 2:
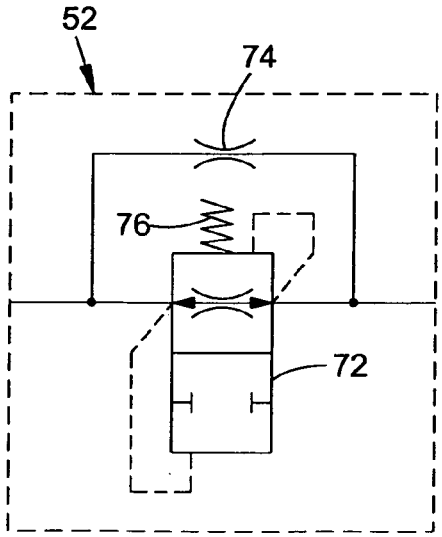
FIG. 2 is a schematic for an alternative volumetric control valve assembly with automatic shut-off valve.

FIG. 2 represents a further volumetric control valve assembly which will be explained by an alternative design example. The valve assembly shown in FIG. 2 replaces the valve assembly shown in FIG. 1. All other components and their functions operate according to the method shown in FIG. 1 and described above. According to FIG. 2 the valve assembly 52 includes an automatic shut-off valve 72 in combination with a choke 74 arranged in parallel instead of the flow regulator 58 and the back pressure valve 60. The choke 74 can also be substituted by an aperture having the same effect. Switching the controller 12 to the float position likewise causes the automatic shut-off valve 72 to effect a flow-dependent reduction or limitation of the flow rate. Should excessive pressure in the first chamber 28 cause the flow rate in the first hydraulic pipe 46 in the float position to exceed a given value at the automatic shut-off valve 72, this in turn causes an opposing pressure differential arising from the force of a closure spring 76 at the automatic shut-off valve 72 thus closing the automatic shut-off valve 72. At the same time the oil flowing from the first chamber 28 is diverted through the choke 74 resulting in a strongly reduced and controllable flow rate and permitting only a low speed of movement for the piston 29. It is also possible to arrange the valve assembly 52 in the direction of the second supply pipe 24 upstream of the on/off valve 50.

Figure 3:
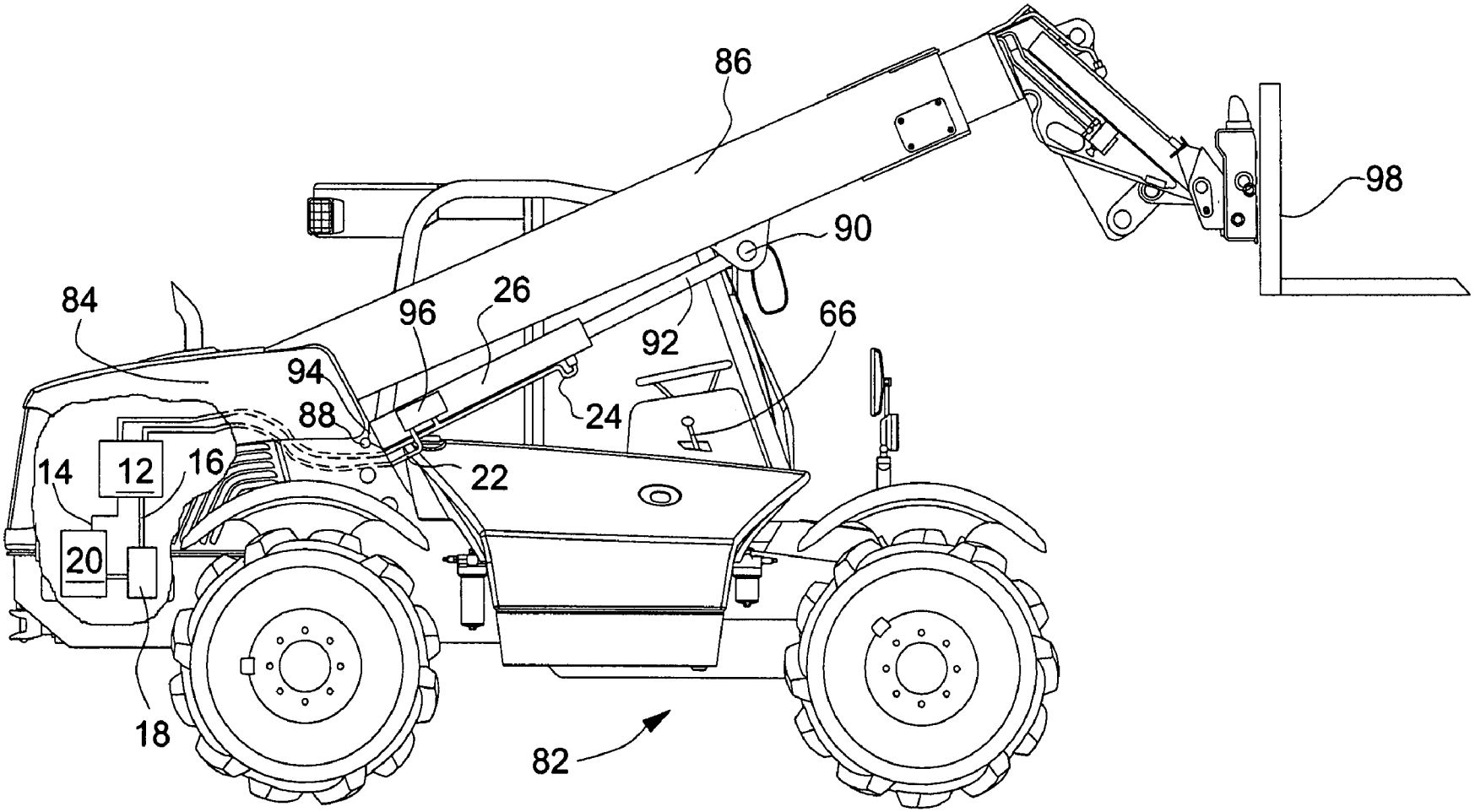
FIG. 3 is a schematic side view of a telescopic loader with a hydraulic arrangement according to the invention used for a hydraulic cylinder.

FIG. 3 represents an application for the design examples presented. FIG. 3 shows a telescopic loader vehicle 82 with an articulated swiveling telescopically controllable boom 86 mounted on a housing 84 or frame of the telescopic loader 82. A hydraulic cylinder 26 for raising and lowering the boom is arranged between the boom 86 and the housing 84. The hydraulic cylinder 26 can be swiveled by means of a first and a second roller bearing 88, 90 with the piston rod side 92 anchored on the second roller bearing 90 on the boom 86 and the piston base side 94 anchored on the first roller bearing 88 on the housing 84. In addition the hydraulic reservoir 20, the pump 18 and the controller 12 are located on or in the housing 84 and connected to each other through the hydraulic pipes 14, 16. A valve block 96 arranged preferably directly on the hydraulic cylinder 26 integrally includes in particular the automatic shut-off valve 32, the on/off valve 50 and the valve assembly 52. FIG. 3 further shows the supply pipes 22, 24 between the valve block 96 and the hydraulic cylinder 26. Control and switch signals are generated by means of the actuator 66 and through an electrical or mechanical drive mechanism (not shown), with which signals the controller 12 and on/off valve 50 are activated or switched (see FIG. 1). The hydraulic cylinder 26 can be activated through the operating switch positions already described in such a way that the boom 86 can be raised, held stationary or lowered. It is also possible to switch to the float position so that the piston can move freely and thus the boom 86 can be moved in a floating condition. The float position ensures that a tool 98 mounted on the boom 86 and lowered to the ground in a floating condition can be moved along the ground surface following the ground contour. The contact pressure of the tool 98 on the ground is thus determined essentially by the weight of the boom 86 and the tool 98. A safety precaution is provided in that the boom 86 can be lowered under load under volumetric control thus avoiding any undesired sudden change in movement. For example, if the boom 86 is in a raised position under load and switched to the float position, the flow regulator 58 or alternatively the automatic shut-off valve 72 in combination with the choke 74 ensures that the boom 86 is lowered at an adjustable and controllable speed. This float position safety precaution provided by the hydraulic arrangement 10 enables switching from any operating position to a float position without leading to uncontrolled change in movement of the boom 86. In addition, a hydraulic arrangement 10 can also be designed with integrated float position combined with a load holding device 32 to enable a pressurized lowering of the boom 86 by switching the controller 12 to the lower position.

It is therefore intended that the foregoing detailed description be regarded as illustrative rather than limiting, and that it be understood that it is the following claims, including all equivalents, that are intended to define the spirit and scope of this invention. Thus, for example the hydraulic arrangement can also be used on other vehicles such as excavators and cranes as well as front loader vehicles with hydraulically driven components that can be raised or lowered and for which a float position appears useful.

What is claimed is:

1. A hydraulic arrangement comprising:

a hydraulic cylinder having a first chamber and a second chamber, a first supply pipe connected to the first chamber and a second supply pipe connected to the second chamber;

a volumetric control valve assembly located within a hydraulic pipe and arranged between the first and second chamber;

a hydraulic fluid feeder in fluid communication with a hydraulic reservoir; and a controller having a raise position, a lower position, a neutral position, and a float position to control the hydraulic cylinder, the second supply pipe being fluidly connected to the hydraulic reservoir when the controller is in the float position, and the first and second supply pipes being substantially prevented from being fluidly connected to the hydraulic fluid feeder when the controller is in the float position.

2. A hydraulic arrangement as in claim 1, wherein the first and second supply pipes are fluidly connected to the hydraulic reservoir through the controller when the controller is in the float position.

3. A hydraulic arrangement as in claim 1, the hydraulic pipe further including an on/off valve having a closed position and an open position.

4. A hydraulic arrangement as in claim 3, further comprising at least one control unit configured to bring the on/off valve to the open position when the controller is in the float position.

5. A hydraulic arrangement as in claim 4, wherein the control unit is configured to bring the on/off valve to the closed position when the controller is in the raise position, the lower position, or the neutral position.

6. A hydraulic arrangement as in claim 1, wherein the controller is a gate valve having at least two inlets and at least two outlets for each switch position.

7. A hydraulic arrangement as in claim 1, the first supply pipe further including an automatic shut-off valve having a back pressure valve configured to close towards the controller and a pressure relief valve configured to be regulated by the pressures prevailing in the supply pipes.

8. A hydraulic arrangement as in claim 1, the valve assembly including an adjustment device to change a flow aperture exposed to at least one of the first supply pipe and the second supply pipe and an urging component applying a spring force to the adjustment device.

9. A hydraulic arrangement as in claim 1, wherein the valve assembly includes a device to narrow a flow aperture in response to a rising pressure gradient at the valve assembly and to widen the flow aperture in response to a falling pressure gradient at the valve assembly.

10. A hydraulic arrangement as in claim 1, wherein the valve assembly includes a flow regulator that changes a volumetric flow rate and limits the volumetric flow rate to a given maximum value.

11. A hydraulic arrangement as in claim 10, wherein the valve assembly includes a back pressure valve arranged in parallel with the flow regulator, the back pressure valve configured to open towards the first chamber.

12. A hydraulic arrangement as in claim 1, wherein the valve assembly includes devices to reduce or interrupt a volumetric flow rate if a given pressure gradient is exceeded.

* * * * *